US007153249B2

(12) United States Patent
O'Connor

(10) Patent No.: US 7,153,249 B2
(45) Date of Patent: Dec. 26, 2006

(54) NARROW WEIGHT TRAINING BENCH FOR FULL SHOULDER MOVEMENT AND WITH INJURY PREVENTING SPINE CONFORMING CONTOUR

(76) Inventor: Douglas O'Connor, 3769 NE. 20th Ave., Ft. Lauderdale, FL (US) 33308

( * ) Notice: Subject to any disclaimer, the term of this patent is extended or adjusted under 35 U.S.C. 154(b) by 273 days.

(21) Appl. No.: 10/155,542

(22) Filed: May 24, 2002

(65) Prior Publication Data

US 2003/0220176 A1 Nov. 27, 2003

(51) Int. Cl.
*A63B 26/00* (2006.01)

(52) U.S. Cl. ..... 482/142; 482/104; D21/675

(58) Field of Classification Search ..... 482/140, 482/142, 907, 104–108, 148; 606/240–245; 5/607, 610, 613, 617–619; D21/671, 686, D21/675–676; 297/452.1, 21, 452.29–30
See application file for complete search history.

(56) References Cited

U.S. PATENT DOCUMENTS 2,562,339 A * 7/1951 Socol ..... 5/617
3,753,592 A * 8/1973 Jensen ..... 297/284.1
3,762,769 A * 10/1973 Poschl ..... 297/284.4
4,124,249 A * 11/1978 Abbeloos ..... 297/217.4
4,621,809 A * 11/1986 Pearl ..... 482/104
4,867,142 A * 9/1989 Jones ..... 601/115
4,927,139 A * 5/1990 Taltre ..... 482/142
5,100,131 A * 3/1992 Fong ..... 482/112
5,725,460 A * 3/1998 Marsh ..... 482/104
5,803,884 A * 9/1998 Sharp ..... 482/142
6,287,243 B1 * 9/2001 Isom et al. ..... 482/142
6,309,018 B1 * 10/2001 Jernstrom ..... 297/284.1
6,572,190 B1 * 6/2003 Koepke et al. ..... 297/284.1
6,843,759 B1 * 1/2005 Wallerstein ..... 482/92

* cited by examiner

*Primary Examiner*—Lori Amerson
(74) *Attorney, Agent, or Firm*—Frank L. Kubler

(57) ABSTRACT

A weight training bench apparatus includes a support frame; an elongate bench platform mounted on the support frame at an angle to define a platform upper end and a platform lower end and having upper and lower platform segments extending between the platform upper end and the platform lower end, the upper platform segment being positioned at a first angle relative to a horizontal direction, and the lower platform segment having an upper first portion extending at a second angle relative to a horizontal direction which is smaller than the first angle to protrude forwardly from the upper platform segment, to follow the curvature of the user spine lumbar region, and has a lower second portion positioned at a third angle relative to a horizontal direction which is larger than the second angle, and a seat mounted to extend forwardly from the platform lower end.

9 Claims, 4 Drawing Sheets

NARROW WEIGHT TRAINING BENCH FOR FULL SHOULDER MOVEMENT AND WITH INJURY PREVENTING SPINE CONFORMING CONTOUR

BACKGROUND OF THE INVENTION

1. Field of the Invention

The present invention relates generally to the field of exercise equipment and weight training accessories. More specifically the present invention relates to a weight training bench apparatus having a bench platform made up of a series of specially angled and sized platform segments corresponding to natural angles and lengths of the regions of the human spine to fully support virtually all vertebrae of the spine of a user during bench press exercises limiting compression of the vertebrae of the lower back and causing the user to be less likely to excessively arch his back, minimizing the chances of back injury, and permitting a full range of shoulder and arm movement for maximizing exercise effectiveness, safety and comfort.

The inventive bench apparatus includes an elongate bench platform constructed of a platform rear support panel with a layer of foam secured against its forward face covered with a suitable skin material such as vinyl to define a platform top surface. The platform is mounted on a support frame at an adjustable longitudinal angle to define a platform upper end and a platform lower end, and integral upper and lower platform segments extend between the platform upper and lower ends. A seat is mounted on the support frame at the base of and extending forwardly from the platform lower end.

The upper platform segment preferably is linear and positioned at a first angle relative to horizontal, and preferably is of sufficient length to additionally support the back of the user head. Each segment and segment portion preferably is rectilinear and preferably is oriented and sized in length to follow a particular corresponding spinal region which the segment or segment portion is to support. The upper platform segment is of at least 12.5 centimeters, in conformance to the length of the cervical region and preferably is 50 centimeters in length to additionally support the back of the user head. And applicant has empirically determined that the upper platform segment preferably angles 30 degrees toward the front of the person, or forwardly to properly support the cervical region CV. The lower platform segment upper first portion of 28*a* is of 28 centimeters in length and preferably angles 30 degrees rearwardly to follow the natural bend of the user spine and follow and properly support the thoracic region, in conformance to the thoracic region T angle range of 20 to 40 degrees. The lower platform segment lower second portion preferably is of 18 centimeters in length and angles 40 degrees forwardly to complete an inverted V-shaped protrusion together with the upper first portion and to further follow and properly support the bend of the user spine lumbar region. The seat is angled at almost 90 degrees rearwardly, and a gap of about 6.25 centimeters or 2.5 inches preferably is provided between the lower end of the lower platform segment lower second portion and the seat, to properly support the sacral/coccyx region X, although various other gap lengths are contemplated and have been found to be suitable. These general lengths and angles are considered critical to providing proper spinal support for weight lifting, and it is believed that substantial variance from most of the lengths and angles recited above would greatly diminish the intended safety benefits provided by the bench apparatus.

The shape of the lower platform segment thus arches upwardly and inwardly to follow the normal inward lumbar curve of the human lower back, thereby providing full spinal support for the entire spine. As a result, the contoured lower platform segment maximizes safety by preventing bowing of any portion of the user lower spine out of its natural shape and alignment under the loading of lifted weights, and limits compressive force on the vertebrae of the lower spine by providing an upward and inward lower back support protrusion against which the user back is braced against direct downward sliding and pressure and thus which carries a portion of the lifted weight load, for protection against back injury and for enhanced back comfort. The upper platform segment is inventively narrow to permit the user to rotate his or her shoulder blades back around the sides and below the platform top surface to achieve a full range of muscle extension.

2. Description of the Prior Art

There have long been benches for supporting the back of a user during bench press exercises. The earliest were probably bare wooden bench seats. The addition of padding and the substitution of light sturdy tubular frames for wood planks improved safety and convenience. Yet even the most recent workout benches prevent the shoulders from moving to a down and back position while performing bench press exercises, and the pectoral muscles are therefore not fully developed. As a result these muscles develop less and the user risks becoming muscle-bound.

A typical prior bench design is that of Pearl, U.S. Pat. No. 4,621,809, issued on Nov. 11, 1986, discloses a bench construction for use in weight lifting. Pearl teaches a workout bench including a bench top which has an upper surface with recessed portions shaped and sized to receive and restrain an inclined lifter against longitudinal and lateral shifting. The portion (30) of the Pearl bench for supporting the upper back is specifically stated to be "in the area of ten inches" wide. See Pearl column 5, lines 50–54. Ten inches is too wide to permit the shoulder blades of a user to rotate around the sides of the bench, and thus the Pearl bench limits muscle movement and development. Pearl states that the average width of a weight training bench is "10 inches or thereabouts". See Pearl column 1, lines 64–67. The very narrow structure required for full shoulder movement is not disclosed, and the function itself of permitting the shoulders to flex below the level of the bench top is not disclosed either.

Owens et al., U.S. Pat. No. 4,637,608, issued on Jan. 20, 1987, reveals a compact multiple purpose exercise bench. Owens et al. includes a compact exercise bench with an H-shaped support structure at each end connected by a bench platform support portion. A bench platform rests longitudinally along the support portion and is hinged at one end to pivot up to various angles, and means are provided to brace the platform at these various angles. This adjustability of the platform position and other bench accessories facilitate the performance of a large variety of body conditioning exercises. The width of the Owens et al. bench platform is not revealed in the written description. Furthermore, no function of providing downward shoulder movement during bench press exercises is recited. It would be reasonable for one of average skill in the art to conclude that the bench width is conventional. Thus a problem with Owens, et al. is that the bench platform is too wide to permit full, downward shoulder movement.

Stater, U.S. Pat. No. 4,958,833, issued on Sep. 25, 1990, reveals an apparatus for adjusting the resting heights of free-moving barbells on weight training racks or stands.

Stater includes two interconnected upright standards, each having a longitudinal series of upwardly angled pockets along a vertical face. A support plug is inserted into corresponding pockets in the two standards at a given level, and the bar of the barbells is set onto the plugs. There is no indication of a narrow bench width in Stater, and therefore the problem of limited shoulder blade movement is again presented.

Cornell, U.S. Pat. No. 5,018,727, issued on May 28, 1991, teaches a three feature-in-one exercise bench. Cornell includes a longitudinally extending frame, a first side and a second side. Special first legs, second legs and intermediate legs are fixed to the longitudinally extending frame and extend upwardly therefrom. A first seat frame and a second seat frame are swingably supported on the first side and the second side of the frame. The first seat frame is swingable to first and second positions. As in the case of Stater, there is no indication of a narrow bench width, and the problem of limited shoulder blade movement is again presented.

Rockwell, U.S. Pat. No. 4,602,785, issued on Jul. 29, 1986, discloses a barbell exercise bench with rest brackets. The bench is supported by legs at each bench platform corner, and the legs extend upwardly at on end of the bench to form barbell supporting standards. Rennemann, U.S. Pat. No. 3,625,511, issued on Dec. 7, 1971, discloses a multipurpose exercise device. Rennemann includes a flat bench with an inclined arm support, elevated barbell supports and a weight lifting pulley and line arrangement. A problem with the Rockwell and Rennemann devices is that they do not teach a bench which is any narrower than what is conventional. The benches do not appear unusually narrow in the patent figures and there is no teaching of full shoulder movement around the sides of these benches. Thus they share the above-identified functional shortcoming.

It is thus an object of the present invention to provide such a weight training bench apparatus which permits full and unrestricted shoulder blade and arm movement during bench press exercises, for muscle development over an entire range of muscle extension.

It is another object of the present invention to provide such an apparatus which is contoured to fully support all segments of the user spine and thus to maximize exercise effectiveness, safety and comfort.

It is still another object of the present invention to provide such an apparatus which is safe, sturdy and visually appealing.

It is finally an object of the present invention to provide such an apparatus which offers these benefits and yet is substantially equivalent in manufacturing costs to contemporary workout benches.

SUMMARY OF THE INVENTION

The present invention accomplishes the above-stated objectives, as well as others, as may be determined by a fair reading and interpretation of the entire specification.

A weight training bench apparatus is provided for supporting the back of a user while the user lifts weights, the apparatus including a support frame; an elongate bench platform mounted on the support frame at an angle to define a platform upper end and a platform lower end and having upper and lower platform segments extending between the platform upper end and the platform lower end, the upper platform segment being positioned at a first angle relative to horizontal, and the lower platform segment having an upper first portion extending at a second angle relative to horizontal which is smaller than the first angle to protrude forwardly from the upper platform segment, to follow the curvature of the user spine lumbar region, and has a lower second portion positioned at a third angle relative to horizontal which is larger than the second angle, to complete the protrusion formed by the upper first portion and to further follow the spine lumbar region; and a seat mounted on a substantially V-shaped support frame to extend forwardly from the platform lower end.

The platform preferably includes a platform rear support panel having a panel forward face with a layer of foam secured onto said panel forward face. The upper platform segment preferably is substantially rectilinear. The upper platform segment preferably is sized in length to support both a user back and a user head. The first angle preferably substantially matches the third angle.

The upper platform segment preferably is sufficiently narrow to permit the user to rotate his or her shoulder blades around the sides of the platform to achieve a full range of user muscle extension. The platform may be of substantially uniform width along its entire length. The lower platform segment alternatively expands downwardly from the upper platform segment to a width at least one and one half times, and alternatively twice, the width of the upper platform segment to comfortably support a user lower back.

The support frame preferably includes a contour frame member having a contour frame member lower end and a contour frame member upper end and bent into a longitudinal series of linear contour frame member segments, corresponding to and matching in length and orientation each of the platform segments and the first and second portions, for fully supporting each individual platform segment. The support frame preferably further includes a floor base member; a telescoping rear leg assembly extending upwardly from the floor base member to the contour frame member to support and raise and lower the platform upper end; and a front leg assembly extending from the floor base member upwardly and pivotally mounted to the contour frame member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
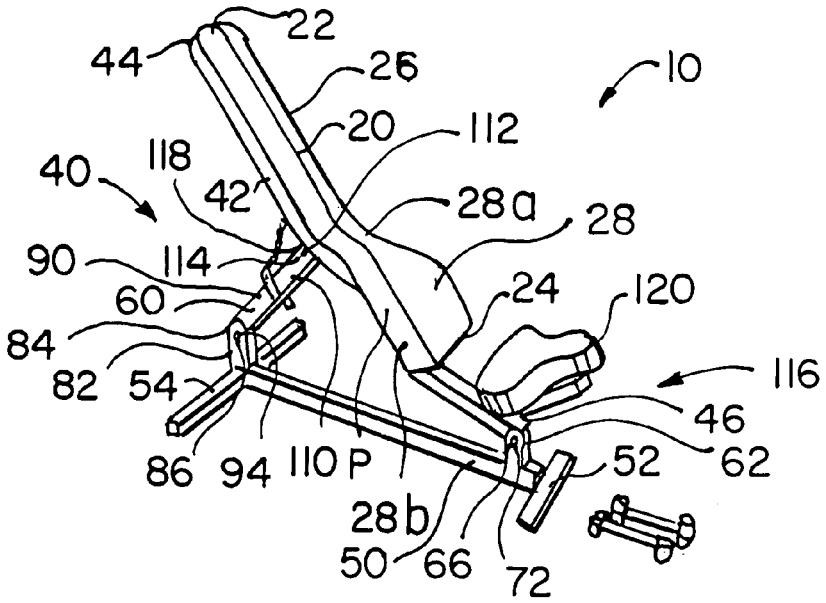
FIG. 1 is a side and forward perspective view of the preferred embodiment of the inventive apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 2:
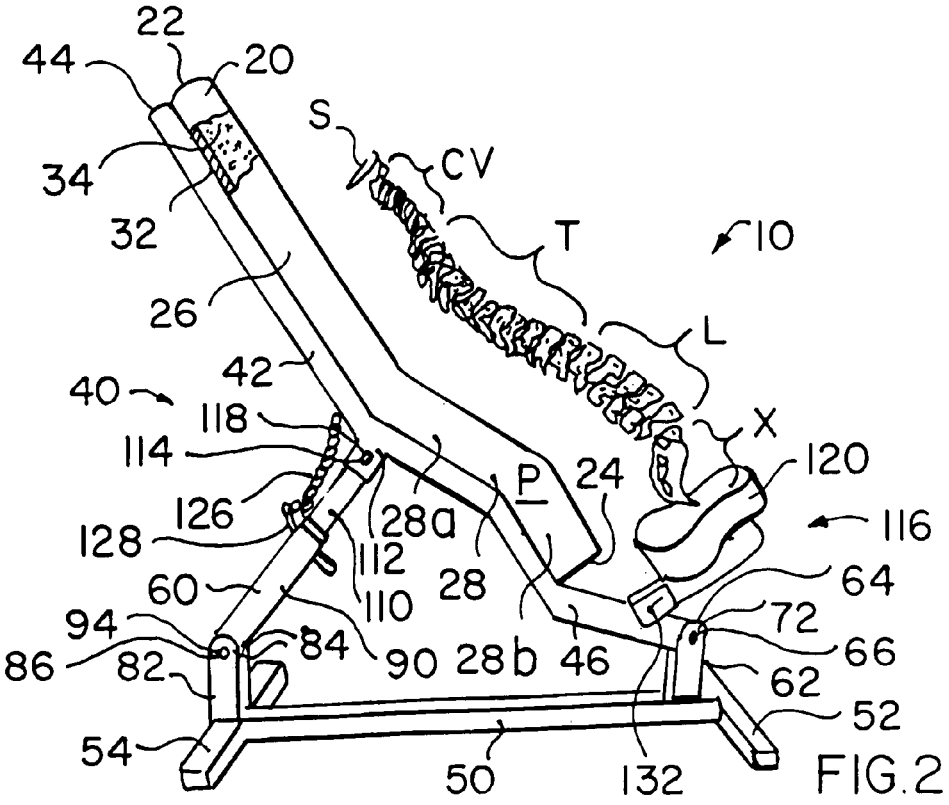
FIG. 2 is a side view of the apparatus showing in profile the portions of the contoured bench platform and indicating which segments of the human spine each portion is oriented to properly support.
Figure 3:
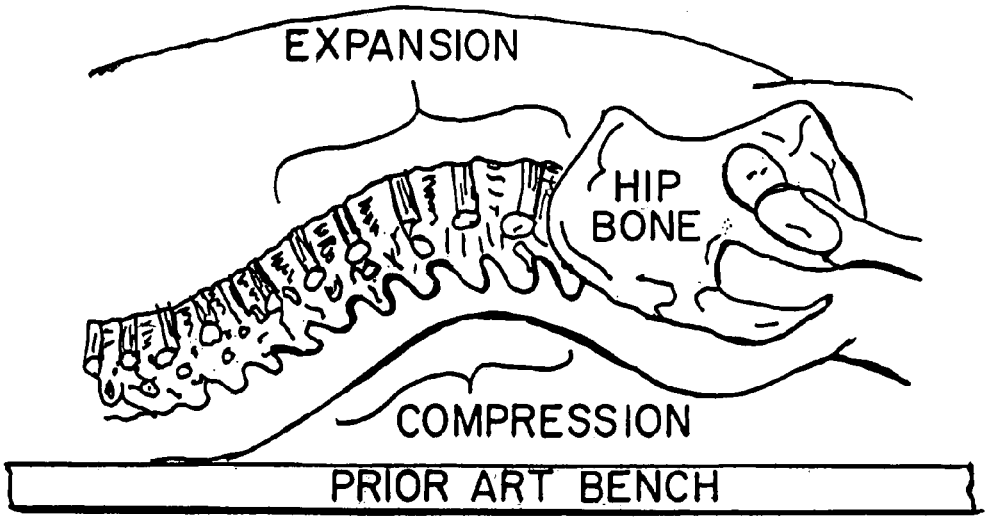
FIG. 3 PRIOR ART
FIG. 3 shows the unhealthy arch of the human back typically produced during strenuous bench pressing of free weights, the back being inadequately supported by a conventional, flat prior art bench shown in this FIGURE. The upper portion of the spine adjacent the hip bone is excessively expanded and the lower portion is excessively contracted, creating a risk of spinal injury. The support provided by the present bench is believed to greatly diminish the tendency to sharply arch the back in this way.
Figure 4:
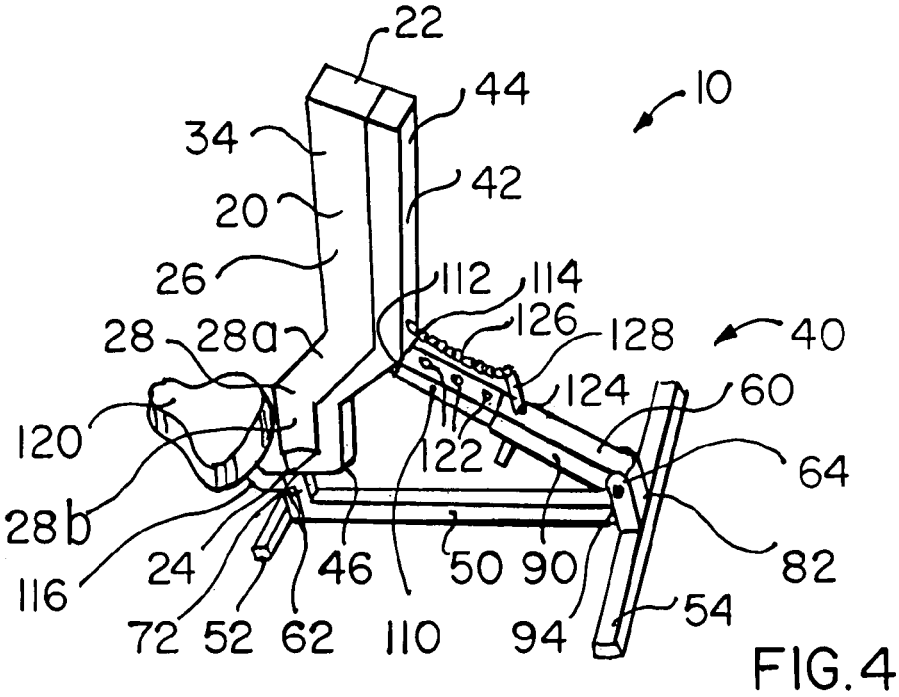
FIG. 4 is an upper rear perspective view of the apparatus of FIG. 1 showing directly the rear leg assembly.
Figure 5:
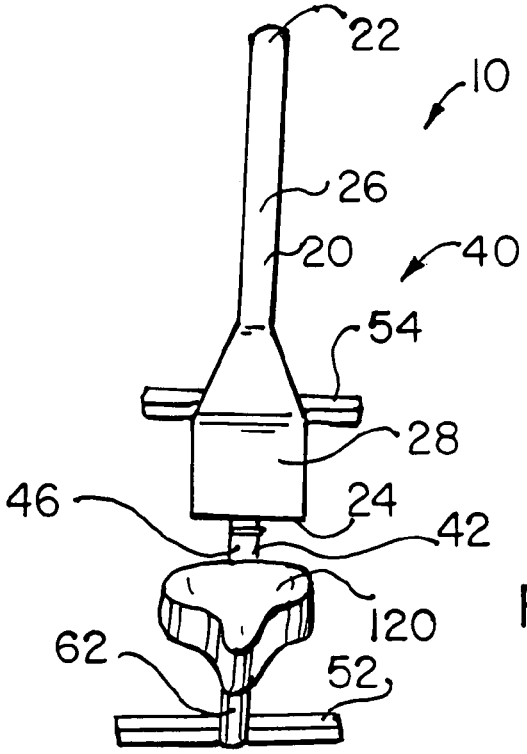
FIG. 5 is a front view of the apparatus of FIG. 1.
Figure 6:
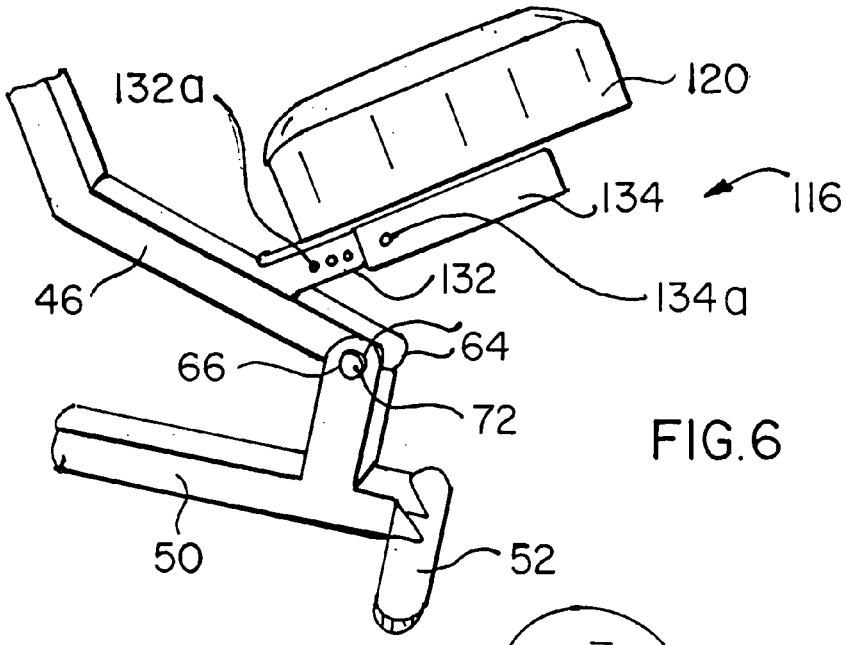
FIG. 6 is a broken away view of the front region of the preferred embodiment, showing the various elements of the telescoping seat support.
Figure 7:
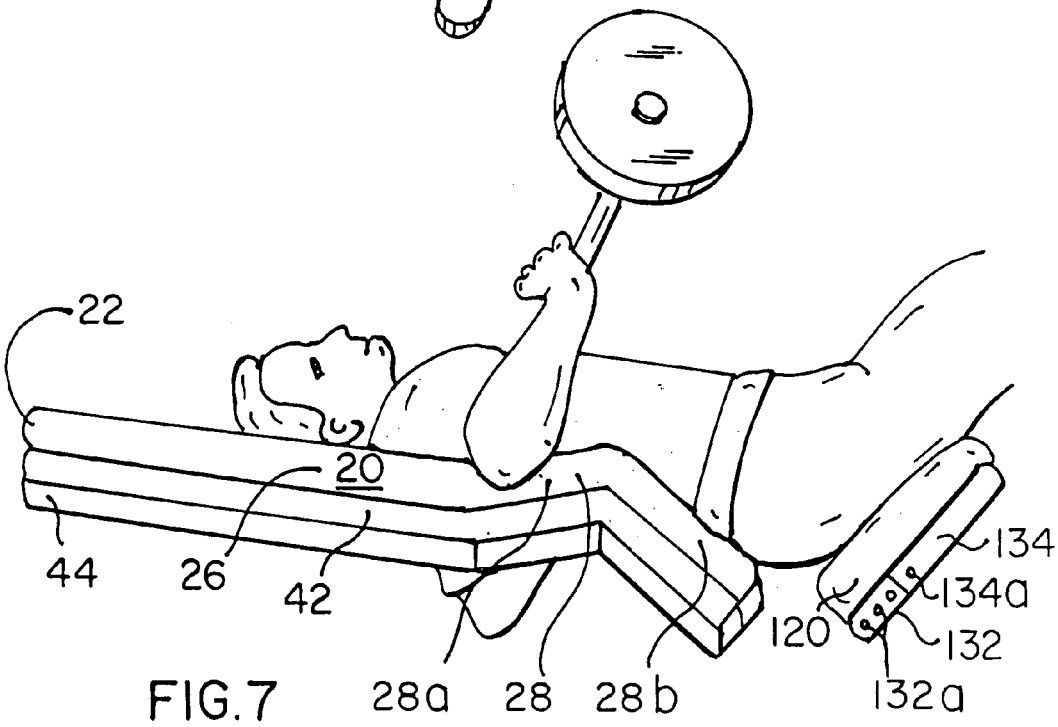
FIG. 7 is a side view of the apparatus bench and seat in their proper spatial relation and supporting an apparatus user.

Referring to FIGS. 1–2 and 4–7, a weight training bench apparatus 10 is disclosed for fully supporting virtually all vertebrae of the spine S of a user during bench press exercises to limit compression of the vertebrae of the lower back and to permit a full range of shoulder and arm movement. As a result, apparatus 10 maximizes exercise effectiveness, safety and comfort.

The inventive bench apparatus 10 includes an elongate bench platform 20 constructed of a platform rear support panel 32 with a layer of foam 34 secured against its forward face and covered with a suitable skin material such as vinyl to define a platform 20 top surface. Platform 20 is mounted on a support frame 40 at an adjustable longitudinal angle to define a platform upper end 22 and a platform lower end 24, and integral upper and lower platform segments 26 and 28, respectively, extending between platform upper and lower ends 22 and 24. A seat 120 is mounted on the support frame 40 at the base of and extending forwardly from platform lower end 24.

To express preferred specific angles, it is convenient to treat the bench platform 26 as being oriented vertically for comparison to an upright human male spine. Each segment and segment portion preferably is rectilinear and preferably is oriented and sized in length to follow a particular corresponding spinal region which the segment or segment portion is to support. See FIG. 2. Upper platform segment 26 is of at least 12.5 centimeters, in conformance to the length of the cervical region CV expressed in *Anatomy of the Human Body*, by Henry Gray, pages 126–128 and preferably is 50 centimeters in length to additionally support the back of the user head. And applicant has empirically determined that upper platform segment 26 preferably angles 30 degrees toward the front of the person, or forwardly to properly support the cervical region CV. The lower platform segment upper first portion of 28*a* is of 28 centimeters in length, in conformance to the length of the thoracic region T expressed in Gray, and preferably angles 30 degrees rearwardly to follow the natural bend of the user spine and follow and properly support the thoracic region T, in conformance to the thoracic region T angle range of 20 to 40 degrees expressed in *Clinical Biomechanics of the Spine*, by Augustus A. White III and Manohar M. Panjabi, Lippencott-Raven, page 116. The lower platform segment lower second portion 28*b* is of 18 centimeters in length, in conformance to the length of the lumbar region L expressed in Gray, and angles 40 degrees forwardly to complete an inverted V-shaped protrusion together with the upper first portion 28*a* and to further follow and properly support the bend of the user spine lumbar region L, in conformance to the angle expressed in *Chiropractic Technic Tortipelvis*, The Slipped Disk Syndrome, Its Cause and Correction, Volume I, by Fred Barge, Fourth Edition, Third Printing (1983), page 44. The seat 120 is angled at almost 90 degrees rearwardly, and a gap of about 6.25 centimeters is provided between the lower end of the lower platform segment lower second portion 28*b* and the seat 120, to properly support the sacral/coccyx region X. These general lengths and angles are considered critical to providing proper spinal support for weight lifting, and it is believed that substantial variance from most of the lengths and angles recited above would greatly diminish the intended safety benefits provided by bench apparatus 10.

The shape of lower platform segment 28 thus arches upwardly and inwardly to follow the normal inward lumbar curve of the human lower back, thereby providing full spinal support for the entire spine S. As a result, the contoured lower platform segment 28 maximizes safety by preventing bowing of any portion of the user lower spine S out of its natural shape and alignment under the loading lifted weights, and limits compressive force on the vertebrae of the lower spine S by providing an upward and inward lower back support protrusion P against which the user back is braced against direct downward sliding and pressure and thus which carries a portion of the lifted weight load, for protection against back injury and for enhanced back comfort.

The upper platform segment 26 is inventively narrow to permit the user to rotate his or her shoulder blades back around the sides and below the platform 20 top surface to achieve a full range of muscle extension. To this end, the optimum upper platform segment 26 width has been found by applicant to be substantially 2.5 inches. Alternatively, the upper platform segment 26 width is in a preferred range of one and one half inches to three and one half inches. The user thus executes bench press exercises with the shoulders positioned "down and back" to isolate the pectoral muscles for fuller development.

Bench platform 20 may be of substantially uniform width along its entire length. Alternatively, the lower platform segment 28 progressively expands downwardly to a width preferably of at least one and one half to two times the upper platform segment 26, and then extends downwardly at a constant width to the platform lower end 24 to fully and comfortably support the base of the lower back. The seat 120 preferably has the configuration of a conventional bicycle seat.

The support frame 40 preferably includes a contour frame member 42 in the form of a metal tube of square cross-section having a contour frame member lower end 46 and a contour frame member upper end 44 and bent into a longitudinal series of linear contour frame member segments, corresponding to and matching in length and in orientation each of the platform segments 26 and 28 and first and second portions 28*a* and 28*b*, for fully supporting each individual platform segment or portion. The platform rear support panel 32 is formed of a longitudinal series of substantially linear support panel segments for each of the platform segments 26 and 28 and segment portions 28*a* and 28*b*, and each support panel segment and portion is fastened to a corresponding contour frame member 42 segment. Support frame 40 further includes an I-shaped floor base member 50 and a pivotable and extendable rear leg assembly 60 extending upwardly from the floor base member rearward end 54 to meet and engage the contour frame member 42, preferably at a point adjacent to where the upper and lower platform segments 26 and 28 meet, and a pivotable front leg assembly 60 extending from the floor base member forward end 52 upwardly to meet and engage the contour frame member 42.

Front leg assembly 60 preferably includes an upright tubular front leg post 62 welded to the floor base member 50 and having upwardly extending opposing front leg flange portions 64 with registering front leg post pivot pin ports 66, the upwardly extending contour frame member lower end 46 being fitted between the rear leg flange portions 64 and having contour frame member pivot pin ports registering with the post pivot pin ports 66, and a front leg pivot pin 72 fitted through the registering pivot pin ports 66, so that contour frame member 42 pivots forwardly and rearwardly on front leg pivot pin 72.

The rear leg assembly 60 preferably includes an upright tubular rear leg post 82 welded to the floor base member 50 and having upwardly extending opposing rear leg flange portions 64 with registering rear leg post pivot pin ports 86, an upwardly and forwardly extending outer telescoping tube 90 having an outer telescoping tube 90 lower end fitted between the rear leg flange portions 64 and having outer telescoping tube pivot pin ports (not shown) registering with the rear leg post pivot pin ports 86, and a rear leg pivot pin 94 fitted through the registering pivot pin ports, so that the outer telescoping tube 90 pivots forwardly and rearwardly on the rear leg pivot pin 94, and includes an inner telescoping tube 110 slidably extending within the outer telescoping tube 90. Inner telescoping tube 110 extends between and is pivotally secured to a pair of rear contour frame member pin flanges 112 extending downwardly from the contour frame member 42 with a rear contour frame member pin 114 passing through registering pin ports including 118 in the inner telescoping tube 110 and in the rear contour frame member pin flanges 112, respectively, so that the outer telescoping tube 90 pivots forwardly and rearwardly on the rear leg pivot pin 94. Inner telescoping tube 110 includes a series of selectable height adjustment ports 122 and the outer telescoping tube 90 includes a fixed height adjustment port 124, and a removable height adjustment pin 128 secured to apparatus 10 with a retaining chain 126 fits through the fixed height adjustment port 124 and through one of the selectable height adjustment ports 122 to position the contour frame member upper end 46 at a certain elevation determined by which selectable height adjustment port 122 registers with the fixed height adjustment port 124.

A telescoping seat support 116 permits seat height adjustment. See FIG. 6. The telescoping seat support 116 includes a seat support arm 132 connected to and projecting forwardly and slightly upwardly from the contour frame member lower end 46, the seat support arm 132 having a longitudinal series of support arm pin ports 132*a* in its side, and includes an outer telescoping seat support tube 134 slidably and telescopingly fitted around the seat support arm 132, the seat 120 being secured to the upper surface of the seat support tube 134 and having a support tube pin port 134*a*. The seat 120 is extended away from the contour frame member lower end 46 as far as desired, and then a seat pin 136 is fitted through the support tube pin port 134*a* and a given registering support arm pin port 132*a* to secure the seat 120 at the selected extension.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A weight training bench apparatus for supporting the back of a user while the user lifts weights, comprising:

A support frame including an base member and a leg assembly extending upwardly from said base member to engage a contour frame member; an elongate bench platform mounted on said support frame to define a platform upper end and a platform lower end and having upper and lower platform segments extending between the platform upper end and the platform lower end, said upper platform segment being positioned at least 12. 5 centimeters in conformance to a length of a cervical region to support the back of a user's head, said upper platform segment at a first angle approximately 30 degrees forward relative to a horizontal direction, said narrow upper platform segment permits the user to rotate his or her shoulder blades back around the sides and below the platform top surface to achieve a full range of muscle extension, and said lower platform segment having an upper first portion extending approximately 28 centimeters in length in conformance to the length of the thoracic region and at a second angle of at least 20 degrees and at most 40 degrees rearwardly relative to a horizontal direction to follow the curvature of the user spine thoracic region, and has a lower second portion positioned approximately 18 centimeters in length in conformance to the length of a lumbar region at a third angle of approximately 40 degrees forwardly relative to a horizontal direction, to complete a substantially V-shaped protrusion formed by the upper first portion and to further follow the bend of the user spine lumbar region;

a seat mounted on said support frame at an angle of approximately 90 degrees and extending forwardly from said platform lower end and a gap approximately 6.25 centimeters between said lower end of said lower platform segment lower second portion and said seat to properly support the sacral/coccyx region, thereby providing full and proper spinal support and maximizing safety to the user by preventing bowing of any portion of the user's lower spine out of its natural shape and alignment under the loading of lifted weights, and limits compressive force on the vertebrae of the lower spine by providing an upward and inward lower back support protrusion against which the user's back is braced against direct downward sliding and pressure and thus which carries a portion of the lifted weight load for protection against back iniury and for enhanced back comfort for safe weight lifting.

2. The weight training apparatus of claim 1, wherein said platform comprises a platform rear support panel having a panel forward face with a layer of foam secured onto said panel forward face.

3. The weight training apparatus of claim 1, wherein said upper platform segment is substantially rectilinear.

4. The weight training apparatus of claim 1, wherein said upper platform segment is sized in length to support both a user back and a user head.

5. The weight training apparatus of claim 1, wherein the first angle substantially matches the third angle.

6. The weight training apparatus of claim 1, wherein said lower platform segment expands downwardly from said upper platform segment to a width at least one and one half times the width of said upper platform segment to comfortably support a user lower back.

7. The weight training apparatus of claim 1, wherein said lower platform segment expands downwardly from said upper platform segment to a width at least twice the width of said upper platform segment to comfortably support a user lower back.

8. The weight training apparatus of claim 1, wherein said A weight training support frame comprising a contour frame member having a contour frame member lower end and a contour frame member upper end and bent into a longitudinal series of linear contour frame member segments, corresponding to and matching in length and orientation each of said platform segments and said first and second portions, for fully supporting each individual said platform segment;

an elongate bench platform mounted on said support frame at an angle to define a platform upper end and a platform lower end and having upper and lower platform segments extending between the platform upper end and the platform lower end, said upper platform segment being positioned at a first angle relative to a horizontal direction, and said lower platform segment having an upper first portion extending at a second angle relative to a horizontal direction which is smaller than the first angle to protrude forwardly from said upper platform segment, to follow the curvature of the user spine lumbar region, and has a lower second portion positioned at a third angle relative to a horizontal direction which is larger than the second angle, to complete a substantially V-shaped protrusion formed by the upper first portion and to further follow the spine lumbar region;

and a seat mounted on said support frame to extend forwardly from said platform lower end.

9. The weight training apparatus of claim 8, wherein said rear leg further being telescopically extending upwardly from said floor base member to said contour frame member to support and raise and lower said platform upper end; and said front leg assembly extending form said floor base member upwardly and pivotally mounted to said contour frame member.

* * * * *